US006561230B1

(12) United States Patent
Ikeda et al.

(10) Patent No.: US 6,561,230 B1
(45) Date of Patent: May 13, 2003

(54) WEFT KNITTED FABRIC

(75) Inventors: Masataka Ikeda, Takatsuki (JP); Hiroshi Yamazaki, Ibaraki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/088,893

(22) PCT Filed: Sep. 29, 2000

(86) PCT No.: PCT/JP00/06803

§ 371 (c)(1),
(2), (4) Date: Mar. 25, 2002

(87) PCT Pub. No.: WO01/23654

PCT Pub. Date: Apr. 5, 2001

(30) Foreign Application Priority Data

Sep. 30, 1999 (JP) ..... 11-279072

(51) Int. Cl.[7] ..... D03D 15/08

(52) U.S. Cl. ..... 139/420 R; 139/426; 139/420 B; 66/202; 28/155

(58) Field of Search ..... 139/420 R, 426, 139/420 B; 66/202; 28/155; 428/225; 57/252; 2/243.1

(56) References Cited

U.S. PATENT DOCUMENTS 3,287,788 A * 11/1966 Goodbar et al. ..... 139/421
4,670,326 A * 6/1987 Heiman ..... 139/420 A
4,900,613 A * 2/1990 Green ..... 442/189
5,313,774 A * 5/1994 Matsumoto et al. .... 139/420 R
5,427,156 A 6/1995 Saito

FOREIGN PATENT DOCUMENTS

| | | |
|---|---|---|
| JP | 04214468 | 8/1992 |
| JP | 7-3588 | 1/1995 |
| JP | 07179335 | 7/1995 |
| JP | 08311751 | 11/1996 |
| JP | 11-12902 | 1/1999 |
| JP | 11200175 | 7/1999 |

* cited by examiner

*Primary Examiner*—John J. Calvert
*Assistant Examiner*—Robert H. Muromoto, Jr.
(74) *Attorney, Agent, or Firm*—Finnegan, Henderson, Farabow, Garrett & Dunner, L.L.P.

(57) ABSTRACT

A weft knitted fabric made from a poly(trimethylene terephthalate) fiber yarn and not containing other elastic yarns such as a polyurethane yarn, a polyester type elastic yarn and a polyester ether type elastic yarn, and showing an elongation under constant load in a range from 80 to 250% in the weft direction under a load of 19.6N per 2.5 cm, an elongation elastic modulus after elongation by 50% of 80% or more in the weft direction, a fabric weight per square meter in a range from 80 to 500 g/m$^2$, a bulk density in a range from 0.28 to 0.60 g/cm$^3$ and a shear rigidity G in a range from 0.28 to 1.50 cN/cm•deg.

7 Claims, No Drawings

WEFT KNITTED FABRIC

TECHNICAL FIELD

The present invention relates to a weft knitted fabric and, particularly, to a weft knitted fabric having a dry touch, producing a soft feeling, showing excellent stretchability and elongation recovery, and giving an excellent comfortable feeling to the wearer.

BACKGROUND ART

Weft knitted fabrics having as principal components poly (ethylene terephthalate) (hereinafter referred to as PET) fibers or nylon fibers, that are synthetic fibers, have been widely used for outerwear and innerwear applications. A weft knitted fabric having a PET fiber as its principal component is excellent in wash-and-wear properties, dimensional stability and yellowing resistance. However, the knitted fabric has the following disadvantages. It has a stiff feeling, shows insufficient stretchability and poor drapability, and gives a less comfortable feeling to the wearer.

Furthermore, a weft knitted fabric having a nylon fiber as its principal component has a soft feeling but with a slimy feeling, and shows stretchability to some extent. However, the knitted fabric has the disadvantages that it has poor wash-and-wear properties, shows low dimensional stability and has decreased yellowing resistance.

On the other hand, as a knitted fabric for which a poly(trimethylene terephthalate) (hereinafter referred to as PTT) fiber yarn is used, Japanese Unexamined Patent Publication (Kokai) No. 11-12902 discloses a mixed knitted fabric prepared by mixed knitting a cellulose fiber yarn with a PTT fiber yarn. The technology disclosed in the patent publication aims at obtaining a knitted fabric that produces neither streaks nor shade bars, and relates to a process that comprises scouring and dyeing a mixed knitted fabric of a warp knitted fabric, a circular knitted fabric or a flat knitted fabric with a fluid-jet dyeing machine, and treating the knitted fabric with a finish agent.

Furthermore, Japanese Unexamined Patent Publication (Kokai) No. 11-200175 discloses a woven or knitted fabric formed from a PTT yarn and excellent in color developing properties. The patent publication discloses a process that comprises shrinking a single feeder knitted fabric by 5.8% in the warp direction during scouring, heat treating the resultant knitted fabric, dyeing the knitted fabric, and heat treating the dyed knitted fabric again.

However, any of the knitted fabrics disclosed by the above prior art has the problem that it has a stiff feeling, shows poor stretchability, and gives a less comfortable feeling to the wearer.

DISCLOSURE OF THE INVENTION

An object of the present invention is to provide a weft knitted fabric excellent in wash-and-wear properties, dimensional stability and yellowing resistance, having a dry touch and a soft feeling, showing excellent stretchability (represented by an elongation under constant load in the weft direction in the present invention) and an excellent elongation recovery (represented by an elongation elastic modulus in the weft direction in the present invention), and providing an excellent comfortable feeling to the wearer.

Another object of the present invention is to provide a weft knitted fabric particularly suitable for outerwear applications.

A PTT fiber is excellent in wash-and-wear properties, dimensional stability and yellowing resistance, has a soft feeling derived from a low Young's modulus and a dry touch feeling, and shows an excellent elastic recovery. However, when a weft knitted fabric is produced from the PTT fiber by a conventional method, only a knitted fabric having a stiff feeling, showing a low stretchability and providing a less comfortable feeling to the wearer is obtained.

In order to make a weft knitted fabric prepared from a PTT fiber manifest a particularly soft feeling, a high stretchability and an excellent elongation recovery, the present inventors have intensively investigated the relationship between a feeling, stretchability, etc. and the fine structure of a yarn, the physical properties of the yarn, the knitted fabric structure, and changes in the knitted fabric structure in a knitting process and a dyeing and finishing process. As a result, they have found the following phenomenon specific to the PTT fiber. Knitting shrinkage caused by a yarn tension in a knitting process is relatively significantly produced. When the gray fabric is thermally shrunk in the dyeing and finishing process, the bulk density of the knitted fabric increases. Consequently, the knitted fabric has a stiff feeling, and shows a lowered stretchability.

For example, when a circular knitted fabric or flat knitted gray fabric is prepared by a process conventionally carried out on a PET yarn, etc. as disclosed in Japanese Unexamined Patent Publication (Kokai) No. 11-12902 mentioned above, the knitting shrinkage becomes significant. As a result, the density of the gray fabric becomes excessively high. When the gray fabric is dyed and finished by a process conventionally carried out on a PET fiber, etc., a shrinkage of the gray fabric caused by heat treatment in the dyeing process, etc. makes the bulk density of the knitted fabric considerably high. As a result, the knitted fabric thus obtained has a stiff feeling, shows a low stretchability in the weft direction, and gives a significantly less comfortable feeling to the wearer.

The present inventors have paid attention to such problems specific to the PTT knitted fabric, and discovered that when the design of a gray fabric and the knitting conditions of the PTT knitted fabric, and dyeing and finishing conditions of the knitted fabric are made proper, the bulk density of the PTT knitted fabric thus obtained can be made to fall in a proper range, and that a weft knitted fabric having a soft feeling and excellent in stretchability and elongation recovery can be obtained. Moreover, the present inventors have made the following discovery: in order to make the knitted fabric give a comfortable feeling to the wearer it is important that the knitted fabric be easily elongated in the weft (wale) direction under a low stress, be excellent in elongation recovery and be easily deformed under a low stress in the shear direction in addition to the knitted fabric having a soft feeling.

For example, as the method disclosed in Japanese Unexamined Patent Publication (Kokai) No. 11-200175, when the knitted fabric is shrunk comparatively large in the warp direction by heat treatment of dyeing process, or the like, only a relatively slight reduction in width of the gray fabric takes place, and the knitted fabric thus obtained shows a considerably low stretchability in the weft direction. Moreover, although a weft knitted fabric in which a PET raw yarn is used particularly easily forms runs, the present inventors have found that the PTT weft knitted fabric can be made to show an unexpected effect of hardly forming runs even when the raw yarn is used by setting the elongation under constant load in the weft direction of the fabric in a specific range. The present invention has thus been achieved.

In addition, "runs" herein is also termed "ladderings," and designates a phenomenon wherein a knitted loop is off the knitting construction, and the knit texture linearly gets out of shape in the warp (course) direction in the knitted fabric when a relatively large tension is applied to the knitted fabric in the weft (wale) direction.

That is, the present invention is as described below.

1. A weft knitted fabric comprising a PTT fiber yarn, and showing an elongation under constant load of from 80 to 250% in the weft direction determined by JIS L 1018 under a load of 19.6 N per 2.5 cm.
2. The weft knitted fabric described in the above item 1, wherein the elongation elastic modulus after elongation by 50% in the weft direction determined by JIS L 1018 is 80% or more.
3. The weft knitted fabric described in the above item 2, wherein the fabric weight per square meter is from 80 to 500 g/m$^2$, and the bulk density is from 0.28 to 0.60 g/cm$^3$.
4. The weft knitted fabric described in the above items 2 or 3, wherein the shear rigidity (G) by KES-FB is from 0.28 to 1.50 cN/cm•deg.

DETAILED DESCRIPTION OF THE INVENTION

In the present invention, the PTT fiber designates a fiber of a PTT having trimethylene terephthalate units as principal repeating units, and contains trimethylene terephthalate units in an amount of about 50% by mole or more, preferably 70% by mole or more, more preferably 80% by mole or more, still more preferably 90% by mole or more. Accordingly, the PTT includes a PTT containing as third components other acid components and/or glycol components in a total amount of about 50% by mole or less, preferably 30% by mole or less, more preferably 20% by mole or less, still more preferably 10% by mole or less.

A PTT is produced by subjecting terephthalic acid or a functional derivative thereof, and trimethylene glycol or a functional derivative of trimethylene glycol to a polycondensation reaction in the presence of a catalyst under suitable reaction conditions. In the course of the production, a suitable one or more third components may be added to give a copolymerized polyester. Alternatively, a PTT and, a polyester other than a PTT, such as a PET or nylon, may be blended.

Furthermore, the PTT fiber in the present invention includes composite spun filaments (sheath core, side by side, etc.) fiber formed from a PTT, a polyester other than a PTT, a nylon, and the like.

Examples of the third component to be added include aliphatic dicarboxylic acids such as oxalic acid and adipic acid, alicyclic dicarboxylic acids such as cyclohexanedicarboxylic acid, aromatic dicarboxylic acids such as isophthalic acid and sodium sulfoisophthalic acid, aliphatic glycols such as ethylene glycol, 1,2-propylene glycol and tetramethylene glycol, alicyclic glycols such as cyclohexanedimethanol, aliphatic glycols containing an aromatic group such as 1,4-bis(β-hydroxyethoxy)benzene, polyether glycols such as poly(ethylene glycol) and poly(propylene glycol), aliphatic oxycarboxylic acids such as ω-oxycaproic acid, and aromatic oxycarboxylic acids such as p-oxybenzoic acid. Moreover, a compound (such as benzoic acid or glycerin) having one or three or more ester-forming functional groups may also be used as long as the resultant polymer is substantially linear.

The PTT fiber used in the present invention may contain delustering agents such as titanium dioxide, stabilizing agents such as phosphoric acid, ultraviolet ray absorbers such as a hydroxybenzophenone derivative, nucleating agents such as talc, lubricants such as Aerosil, antioxidants such as a hindered phenol derivative, flame retardants, antistatic agents, pigments, fluorescent brighteners, infrared ray absorbers, defoaming agents, and the like.

In the present invention, there is no specific limitation on the spinning method of the PTT yarn, and any of the methods mentioned below may be adopted: a method comprising spinning at a rate of about 1,500 m/min to give an undrawn yarn, and drawing and twisting the yarn by a draw ratio of about from 2 to 3.5; a direct drawing method (spin draw method) in which a spinning step and a drawing and twisting step are directly connected; a high speed spinning method (spin take-up method) comprising winding at a rate of 5,000 m/min or more; and a method comprising spinning a yarn, cooling the spun yarn once in a water bath, and drawing the cooled yarn.

Although the PTT fiber may be either a filaments yarn or a short fiber, a filaments yarn is preferred. Moreover, the yarn may be uniform, or thick and thin in the longitudinal direction. A filament of the fiber may have a round-shaped, a triangle-shaped, an L-shaped, a T-shaped, a Y-shaped, a W-shaped, an eight lobal-shaped, a flat, a polygonal (e.g., dog bone-shaped), multi-lobal-shaped, a hollow or an indefinitely shaped cross section.

Examples of the PTT fiber yarn include a raw yarn, a false-twisted yarn (including a drawn false-twisted yarn such as POY), first-twisted and false-twisted yarn (e.g., a yarn first twisted at a rate of from 600 to 1,000 T/m in the S or Z direction, and false-twisted in the Z or S direction at a rate of from 3,000 to 4,000 T/m), an air-jet textured yarn, a spun yarn such as a ring spun yarn and an open-end spun yarn, a multifilament raw yarn (including an extremely thin yarn), combined filaments yarn and a yarn obtained by twisting these yarns.

There is no specific limitation on the single filament size of the PTT fiber yarn and, in general, a yarn having a single filament size of from about 0.1 to 11 dtex can be used. However, in order to improve the stretchability and elongation recovery of a knitted fabric, a yarn having a single filament size of from 1 to 8 dtex is more preferred. Moreover, a yarn having a total size of from 30 to 300 dtex is preferred, and a yarn having a total size of from 50 to 200 dtex is particularly preferred.

It is preferred that the PTT fiber used in the present invention shows a breaking strength of from 2.2 to 5.0 cN/dtex, a breaking elongation of from 30 to 55%, an initial elastic modulus of from 14 to 27 cN/dtex, an elastic recovery after elongation by 10% of from 80 to 100% and a boiling water shrinkage of from 6 to 15%.

The PTT fiber of the present invention may be blended with a natural fiber represented by wool or cotton, and a synthetic fiber, as long as the object of the present invention is not impaired, by means such as staple fiber blending (CSIRO spun, CSIRO fil., etc.), interlaced combination (a different shrinkage combined filaments yarn with a high shrinkage yarn, etc.), twisted combination, composite false twisting (elongation-differenced false twisting, etc.) and fluid-jet texturing with two feeds.

The weft knitted fabric containing a PTT fiber yarn in the present invention naturally includes a weft knitted fabric formed from a PTT fiber yarn alone, but it also includes a weft knitted fabric, and the like obtained by mixed-knitting a PTT fiber yarn, and another fiber yarn or other fiber yarns. Examples of the method of mixed-knitting a PTT yarn include a method comprising doubling yarns and feeding the resultant yarn, a method comprising making each yarn form a loop, and a method comprising inserting each yarn without forming a loop. There is no specific limitation on another yarn to be mixed knitted, and any yarn may be used. However, the yarn is preferably a synthetic yarn such as a polyester yarn, a polyamide yarn, a polyacrylic yarn, a polyvinyl yarn and a polypropylene yarn, a natural yarn such as cotton, hemp, wool and silk, a regenerated cellulose yarn such as cuprammonium rayon, rayon and polynosic, and an acetate yarn.

The weft knitted fabric of the present invention can achieve a desired stretchability even when it contains no elastic yarn other than the PTT yarn, namely, an elastic yarn such as a polyurethane yarn, a polyester type elastic yarn and a polyether ester yarn.

The proportion of the PTT fiber yarn forming the weft knitted fabric of the invention is preferably 15% by weight or more, more preferably 40% by weight or more, particularly preferably 80% by weight or more, in view of the feeling (softness) and stretchability of the knitted fabric thus obtained.

Examples of the weft knitted fabric in the present invention include a circular knitted fabric and a flat knitted fabric. Of these fabrics, the circular knitted fabric is particularly preferred. Specific knitted textures include interlock knitting, three step butt interlock knitting, plain knitting, plain tuck float knitting, rib knitting (circular rib knitting, rib stitch knitting), purl stitch knitting, ponti roma knitting, double pique knitting, single pique knitting, half cardigan knitting, eight-lock knitting, blister knitting and fleecy knitting. Moreover, the knitting structure can be either single knitting or double knitting.

The weft knitted fabric of the present invention shows an elongation under constant load in the weft direction of from 80 to 250% determined under a load of 19.6 N per 2.5 cm width by JIS L 1018, preferably from 90 to 200%, more preferably from 100 to 150%. When the elongation under constant load is less than 80%, the knitted fabric shows a lowered stretchability and insufficient adaptability to the body movement of the wearer, and gives a less comfortable feeling to the wearer. On the other hand, when the elongation under constant load exceeds 250%, the elongation elastic modulus is significantly lowered, and the elongation recovery is deteriorated.

The weft knitted fabric of the invention preferably shows an elongation elastic modulus after elongation by 50% in the weft direction of 80% or more measured by the method of JIS L 1018 (constant elongation method). When the elongation elastic modulus is in the above range, the shape stability during wearing then becomes excellent, and the knitted fabric then gives an excellent comfortable feeling to the wearer. The knitted fabric more preferably shows the elongation elastic modulus of 85% or more, particularly preferably 90% or more.

The weft knitted fabric of the present invention preferably shows a shear rigidity (G) by KES-FB of from 0.28 to 1.50 cN/cm•deg., more preferably from 0.30 to 1.30 cN/cm•deg. When the shear rigidity is in the above range, the knitted fabric shows a particularly soft feeling, and gives a significantly comfortable feeling to the wearer.

The shear rigidity (G) herein is a value measured by the KES-FB measurement system (Kawabata's Evaluation System for Fabric). When the measured value is smaller, the fabric has a softer feeling. The KES-FB measurement system is one that can measure the dynamic properties influencing the feeling of a fabric with four types of machines (tensile-shear, pure bending, compression and surface properties). In particular, the shear rigidity (G) represents the deformation of a fabric in the shear (oblique) direction. When the value is smaller, the fabric more tends to be deformed. The fabric shows enhanced adaptability to the body movement of the wearer, and gives an excellent comfortable feeling thereto, when the shear rigidity (G) is set in the above range. The results have been found by the present inventors for the first time.

The weft knitted fabric of the present invention used for outerwear applications preferably has a fabric weight per square meter of 80 g/m$^2$ or more in view of the drapability and elongation recovery. Moreover, the knitted fabric used for clothing applications has a fabric weight per square meter of preferably 500 g/m$^2$ or less in view of the weight, more preferably from 100 to 400 g/m$^2$, particularly preferably from 120 to 350 g/m$^2$.

The weft knitted fabric of the invention preferably has a bulk density of 0.28 g/cm$^3$ or more in view of the elongation recovery. Moreover, it has a bulk density of preferably 0.60 g/cm$^3$ or less in view of the feeling, stretchability and wearer's comfortable feeling, more preferably from 0.30 to 0.55 g/cm$^3$.

The knitted fabric has a density of from 15 to 80 courses/2.54 cm and from 15 to 70 wales/2.54 cm, particularly preferably from 30 to 70 courses/2.54 cm and from 30 to 60 wales/2.54 cm.

A gray fabric prepared by knitting a PTT fiber yarn under conventional knitting conditions used for a PET fiber yarn, etc. shows a large knitting shrinkage, and has a high density. The results are caused by the following properties of the PTT fiber yarn itself has: the yarn is elongated under a low stress, and shows an excellent elongation recovery. When the gray fabric is dyed and finished, the fabric is shrunk particularly in the weft direction during dyeing only to give a knitted fabric having a high bulk density, and showing a high restraining force among yarns, low stretchability and a stiff feeling. It is therefore necessary to use a gray fabric that is designed to have a knitting density coarser by about 10 to 30% than that commonly designed for a conventional PET fiber yarn, or the like, by adjusting the gauge or loop length.

In the present invention, such a coarse weft knitted gray fabric is subjected to a relaxing heat treatment such as hot water, wet heat or dry heat treatment to give a knitted fabric wherein the arrangement and density balance of courses and wales are changed, the crossover point length is changed, crimps are formed by bending of intersecting points, and the shape is changed by crimping the floating portion of the yarn. As a result, the weft knitted fabric manifests a high stretchability and an excellent elongation recovery. On the other hand, when a gray fabric prepared by knitting under conventional knitting conditions used for a PET fiber yarn, etc. is employed, the relaxing heat treatment shrinks the weft knitted gray fabric to excessively increase the bulk density, because the PTT yarn shows a boiling water shrinkage as high as from abut 6 to 15%, and a high thermal stress. Consequently, the degree of freedom among yarns forming the knitted fabric is lowered only to give a fabric having a stiff feeling and showing a low stretchability.

Accordingly, in order to make the gray fabric have a soft feeling, and show a high stretchability and an excellent elongation recovery, it is important that a weft knitted gray fabric having been designed to have a coarse density in advance be heat treated in the dyeing and finishing process to have a proper bulk density. The texture shrinkage in addition to the shrinkage of the yarn itself is thus caused to give fine bending crimps and crimps to the fabric in the course or wale direction, and to simultaneously increase the degree of freedom of the yarn itself forming the knitted fabric.

The weft knitted fabric of the present invention is appropriately obtained by suitably shrinking a coarsely designed gray fabric mainly in the weft (width) direction in the dyeing process. That is, when the weft knitted fabric is to be produced by heat treating the weft knitted gray fabric of a PTT yarn, the knitted fabric can be appropriately obtained by a method of producing a weft knitted fabric having a shrinkage coefficient of from 1.2 to 1.9 that is shown by the formula:

shrinkage coefficient={(number of courses of the product)×(number of wales of the product)}/{(number of courses of the gray fabric)×(number of wales of the gray fabric)} wherein the product designates a weft knitted fabric prepared by dyeing and finishing the gray fabric.

The above shrinkage coefficient is preferably 1.2 or more in view of the elongation recovery and comfortable feeling to the wearer. The shrinkage coefficient is more preferably 1.9 or less in view of the bulk density, feeling, stretchability, shear rigidity and comfortable feeling to the wearer. The shrinkage coefficient is still more preferably from 1.3 to 1.9.

A PET knitted fabric has conventionally been set by tentering a width of fabric at temperature of from 180 to 190° C.

In contrast to the above knitted fabric, the weft knitted fabric of the present invention is, concretely, appropriately subjected to a reduction in width of preferably from 5 to 30%, more preferably from 10 to 20% by the following methods: a method comprising subjecting a coarsely designed gray fabric to heat treatment for reduction in width prior to or subsequently to scouring, with dry heat at temperature of from 150 to 170° C. for a time of from 30 sec to 2 minutes; and a method comprising crumpling and then relaxing the same gray fabric with hot water at temperature of from 80 to 130° C., preferably from 95 to 130° C. using a relaxer, a fluid-jet dyeing machine, or the like.

Still more preferably, the weft knitted fabric is subjected to a reduction in width of from 5 to 30%, more preferably from 10 to 20% by a method comprising subjecting the weft knitted fabric to heat treatment for reduction in width with dry heat at temperature of from 150 to 170° C. for a time from 30 sec to 2 minutes prior to or subsequently to scouring while the reduction in width in the weft direction is being set at from 20 to −5%, more preferably from 10 to −3%, particularly preferably from 5 to 0% (with width maintained), and crumpling and then relaxing the knitted fabric with hot water at temperature of from 80 to 130° C., preferably from 95 to 130° C. using a relaxer or a fluid-jet dyeing machine. Thereafter, the knitted fabric is finally set at temperature of from 150 to 170° C. with a ratio of tentering a width of fabric of from 0 (with width maintained) to 5% to simultaneously show a high stretchability as well as an excellent elongation recovery in the weft direction, and a soft feeling.

In particular, when a textured yarn such as a false-twisted yarn is used, it is preferred to lower the maximum temperatures of these heat treatment temperatures by about 10° C. compared with the texturing temperature of the yarn for the purpose of making the knitted fabric show a high stretchability, an excellent elongation recovery and a soft feeling.

In order to make a PTT yarn have excellent crimps, the false twisting temperature must be set at temperature lower than that of a PET yarn. A textured PTT yarn having excellent crimps can be obtained by false twisting at a temperature of about 170° C. Accordingly, the heat set temperature of the knitted fabric is preferably from 150 to 160° C. When the knitted fabric is heat set at 170° C. or more, the crimps flow; the stretchability and elongation recovery are lowered, and the shape stability becomes insufficient.

Furthermore, the stretchability of the knitted fabric in the warp (longitudinal) direction can be increased by heat setting the fabric while the fabric is being suitably over-fed in the warp (longitudinal) direction.

In addition, examples of the usable heat treating machine include a pin tenter, a clip tenter, a short loop dryer, a shrink surfer drier and a drum drier. In order to obtain a desirable stretchability, a pin tenter that can dimensionally control the fabric in the warp and weft directions is preferred.

In the present invention, a conventional finish texturing agent can be applied to the knitted fabric having such stretchability. In particular, application of a texturing agent capable of decreasing a friction resistance, among filaments of a PTT fiber yarn, is preferred because lowering of the elongation recovery of the knitted fabric subsequent to dry cleaning and washing can be further decreased. Although there is no specific restriction on the texturing agent, an organopolysiloxane that is a compound having a siloxane bond (Si—O—Si) as its fundamental skeleton and showing smoothness, dry cleaning resistance and washing resistance is preferred. An amount of adhesion of such a silicone compound to a fabric is preferably from 0.05 to 2.0% by weight as a pure silicone emulsion mass. The silicone compound can be made to adhere to the fabric by a procedure such as exhaustion treatment, spraying, immersion and squeezing or kiss rolling. Moreover, in order to increase the durability of the fabric, the fabric is preferably heat treated after the adhesion or drying. In addition, the silicone compound may optionally be mixed with a crosslinking agent, a catalyst, a resin, a feeling-adjusting agent, and the like, and used.

Furthermore, the weft knitted fabric of the present invention includes one that is subjected to processing such as calendering, embossing, raising a nap, pleating, printing or opal finishing.

EXAMPLES

The present invention will be further and specifically explained below by making reference to examples.

In addition, measurement methods, evaluation methods, and the like are as explained below.

(1) Reduced Viscosity ($\eta_{sp}/c$)

A polymer is dissolved in o-chlorophenol at 90° C. in a concentration of 1 g/dl, and the solution thus obtained is placed in an Ostwald viscometer. Measurements are made on the solution, and the reduced viscosity ($\eta_{sp}/c$) is calculated from the following formula:

$$\text{reduced viscosity } (\eta_{sp}/c)=(T/T_0-1)/c$$

wherein T is a drop time (sec) of the sample solution, $T_0$ is a drop time (sec) of the solvent and c is a concentration (g/dl) of the solution.

(2) Elastic Recovery (%)

A yarn sample is attached to a tensile testing machine with a chuck-to-chuck distance set at 20 cm, elongated at a tensile rate of 20 cm/min until the sample is elongated by 10%, followed by allowing the sample to stand for 1 minute. The sample is then shrunk at the same rate to give a stress-strain curve. During the shrinkage, the elongation shown by the sample when the stress becomes zero is defined as a residual elongation (A), and the elastic recovery is obtained from the following formula:

$$\text{elastic recovery (\%) after elongation by 10\%}=\{(10-A)/10\}\times 100$$

(3) Boiling Water Shrinkage (BWS)

The boiling water shrinkage is measured in accordance with the testing method of boiling water shrinkage (B method) by JIS L 1013. In addition, the hot water temperature is set at about 100° C. (boiling temperature).

(4) Elongation (%) under Constant Load

The elongation under constant load by JIS L 1018 of a sample is measured in the wale (weft) direction alone in accordance with the grab method. The sample size is 10 cm (warp)×15 cm (weft). The measurement is made under constant load of 19.6 N per 2.5 cm width.

(5) Fabric weight per square meter ($g/m^2$)

The fabric weight per square meter is measured in accordance with the method of measuring a conditioned weight by JIS L 1018.

(6) Bulk Density ($g/cm^3$)

The thickness of a sample is measured in accordance with the measurement method by JIS L 1018 for a constant time of 10 sec under an initial load of 9.8 kPa. The bulk density is obtained by dividing the fabric weight per square meter obtained in (5) by the thickness thus obtained.

(7) Shear Rigidity: G (cN/cm•deg.)

The shear rigidity is an average value obtained by making measurements on a sample in the course (warp) and wale (weft) directions under the following conditions, using a KES-FB1 (trade name, a tensile-shear testing machine, manufactured by Kato Tekku K.K.).

(Condition of Measuring a Shear rigidity G)

Maximum shear angle: ±8°

Shear slip rate: 5 mm/12 sec

Forced load: 9.8 cN/cm

Effective sample: 20×5 cm (8) Elongation Elastic Modulus (%)

The elongation elastic modulus of a sample is measured in the wale direction alone in accordance with the elongation elastic modulus A method (constant elongation method) by JIS L 1018. The size of the sample is 10 cm (warp)×15 cm (weft). Measurement of the elongation elastic modulus is made on the sample by the grab method at a tensile rate of 10 cm/min and a constant elongation of 50%.

(9) Feeling

Ten panelists judged the feeling to touch of a sample. Each panelist was asked to evaluate the sample, and gave the sample the following points: 0 point is gave when the sample produces a stiff feeling; and 1 point is given when the sample produces a flexible feeling. The feeling (flexibility) of the sample is judged from the total points given by the panelists in accordance with the following criteria:

ⓞ for 9 to 10 points; ○ for 7 to 8 points; Δ for 4 to 6 points; and × for 0 to 3 points.

(10) Comfortable Feeling to the Wearer

Three female one-piece garments are prepared from each of the fabrics. Three panelists are each asked to wear one of the three garments for a week. Each panelist evaluated the comfortable feeling of the garment she had worn according to the following three ranks: rank A (excellent comfort); rank B (ordinary comfort); and rank C (poor comfort).

Each of the fabrics is judged in accordance with the following criteria: ⓞ the three panelists all judge the fabric to be rank A; ○ two out of the three panelists judge the fabric to be rank A; and × at least two panelists out of the three panelists judge the fabric to be rank C; and Δ other

(11) Run

A constant load of 19.6 cN per 2.5 cm is applied to a sample in the wale (weft) direction, in the same manner as in (4) explained above, except that the size of the sample is changed to 5 cm (warp)×15 cm (weft). Whether a run is formed or not is visually judged.

A mark ○ indicates that a run is not formed, and a mark × indicates that a run is formed.

Example 1

A PTT having a reduced viscosity ($\eta_{sp}/c$) of 0.8 was spun at a spinning temperature of 265° C. and a spinning rate of 1,200 m/min to give an undrawn yarn. The undrawn yarn was drawn and twisted at a hot roll temperature of 60° C., a hot plate temperature of 140° C., a draw ratio of 3 and a drawing rate of 800 m/min to give a drawn yarn of 84 dtex/36 f. The drawn yarn showed a strength of 2.9 cN/dtex, an elongation of 45%, an elastic modulus of 24 cN/dtex, an elastic recovery after elongation by 10% of 94% and a boiling water shrinkage of 14%.

Using a 32-gauge circular knitting machine, the raw yarn obtained in the above process was knitted while the loop length was set at 30.4 cm/100 wales (the length being longer by 15% than that of a PET yarn in Comparative Example 1 to be described later) to give an interlock knitted gray fabric having a density of 45 courses/2.54 cm and 44 wales/2.54 cm.

The knitted gray fabric was scoured at 90° C. for 20 minutes with a fluid-jet dyeing machine, dyed with a dispersion dye at 120° C. for 30 minutes using the fluid-jet dyeing machine, and reduction cleaned. The fabric was then washed with water, dehydrated, opened, and dried. The dried knitted fabric was then impregnated with a conventional finish agent, final set at 170° C. for 1 minute while the width was being maintained to give a knitted fabric of 49 courses/2.54 cm and 54 wales/2.54 cm. Table 1 shows the results of evaluating the knitted fabric thus obtained.

Comparative Example 1

An interlock knitted gray fabric of 46 courses/2.54 cm and 48 wales/2.54 cm formed from a PET yarn was prepared in the same manner as in Example 1 except that a PET yarn of 84 dtex/36 f (manufactured by Asahi Chemical Industry Co., Ltd.) was used in place of the PTT yarn used in Example 1 and that the loop length was 26.4 cm/100 wales.

A knitted fabric of 48 courses/2.54 cm and 55 wales/2.54 cm was obtained in the same manner as in Example 1 except that the knitted gray fabric was dyed at 130° C. and final set at 180° C. Table 1 shows the results of evaluating the knitted fabric thus obtained.

It is evident from Table 1 that the knitted fabric compared with that in Example 1 showed a low elongation under constant load, a low elongation elastic modulus and a high shear rigidity and had a stiff feeling. Moreover, the knitted fabric gave a poor wearable feeling, and runs were formed.

Example 2

The two raw yarns obtained in Example 1 were doubled to form a raw yarn of 167 dtex/72 f. The raw yarn was knitted using a 32-gauge circular knitting machine while the loop length was set at 22.0 cm/100 wales (the length being longer by 10% than that for a PET yarn in Comparative Example 2 to be described later) to give an interlock knitted gray fabric having a density of 44 courses/2.54 cm and 46 wales/2.54 cm.

The knitted gray fabric was treated in the same manner as in Example 1 to give a knitted fabric of 56 courses/2.54 cm and 58 wales/2.54 cm. Table 1 shows the results of evaluating the knitted fabric thus obtained.

Comparative Example 2

An interlock knitted gray fabric of 49 courses/2.54 cm and 48 wales/2.54 cm formed from a PET yarn was obtained in the same manner as in Example 1 except that a PET yarn of 167 dtex/72 f (manufactured by Asahi Chemical Industry Co., Ltd.) was used in place of the PTT yarn used in Example 2, and that the loop length was altered to 20.0 cm/100 wales.

The knitted gray fabric was treated in the same manner as in Example 1 except that the fabric was dyed at 130° C. and final set at 180° C. to give a knitted fabric of 56 courses/2.54 cm and 57 wales/2.54 cm. Table 1 shows the results of evaluating the knitted fabric thus obtained.

It is evident from Table 1 that the knitted fabric compared with that in Example 2 showed a low elongation under constant load, a low elongation elastic modulus, a high shear rigidity and a stiff feeling. Moreover, the knitted fabric gave a poor wearable feeling, and runs were formed.

Example 3

The two raw yarns obtained in Example 1 were doubled to give a raw yarn of 167 dtex/72 f. The raw yarn was knitted while the loop length was set at 32.8 cm/100 wales (the length being longer by 10% than that of the PET yarn in Comparative Example 3 to be described later) to give an interlock knitted gray fabric having a density of 32 courses/2.54 cm and 36 wales/2.54 cm.

The knitted gray fabric was treated in the same manner as in Example 1 to give a knitted fabric having a density of 40 courses/2.54 cm and 44 wales/2.54 cm. Table 1 shows the results of evaluating the knitted fabric thus obtained.

Comparative Example 3

An interlock knitted gray fabric was prepared from a PET yarn of a density of 28 courses/2.54 cm and 42 wales/2.54 cm in the same manner as in Example 1 except that a PET yarn of 167 dtex/72 f (manufactured by Asahi Chemical Industry Co., Ltd.) was used in place of the PTT yarn used in Example 3, and that the loop length was changed to 29.8 cm/100 wales.

The knitted gray fabric was treated in the same manner as in Example 1 except that the fabric was dyed at 130° C. and final set at 180° C. to give a knitted fabric of 34 courses/2.54 cm and 43 wales/2.54 cm. Table 1 shows the results of evaluating the knitted fabric thus obtained.

It is evident from Table 1 that the knitted fabric compared with that in Example 3 showed a low elongation under constant load, a low elongation elastic modulus, a high shear rigidity and a stiff feeling. Moreover, the knitted fabric gave a poor wearable feeling, and runs were formed.

Example 4

The PTT yarn of 84 dtex/36 f obtained in Example 1 was false twisted under the conditions shown below to give a false twisted yarn.

The false twisted yarn thus obtained was knitted while the loop length was set at 37.0 cm/100 wales (the length being longer by 20% than that of the PET yarn to be described later in Comparative Example 4) with a 32-gauge circular knitting machine to give an interlock knitted gray fabric having a density of 32 courses/2.54 cm and 49 wales/2.54 cm.

The knitted gray fabric was treated in the same manner as in Example 1 except that the fabric was final set at 160° C. for 1 minute with the width maintained to give a knitted fabric having a density of 60 courses/2.54 cm and 49 wales/2.54 cm. Table 1 shows the results of evaluating the knitted fabric thus obtained.

<False-Twisting Conditions>

False twisting machine: ARCT-450 B, pin false twisting machine

Yarn speed: 84 m/min

Spin rotational speed: 277,000 rpm

Number of false twists: 3,600 T/m

First feed: 0%

Heater temperature: 170° C.

TU feed: 5.03%

Comparative Example 4

The PET yarn (manufactured by Asahi Chemical Industry Co., Ltd.) of 84 dtex/36 f used in Comparative Example 1 was false twisted under the false twisting conditions shown below to give a false twisted yarn.

An interlock knitted gray fabric formed from a PET yarn and having a density of 51 courses/2.54 cm and 47 wales/2.54 cm was prepared in the same manner as in Example 4 except that the false twisted yarn thus obtained was used and that the loop length was changed to 30.8 cm/100 wales.

A knitted fabric having a density of 58 courses/2.54 cm and 49 wales/2.54 cm was obtained in the same manner as in Example 1 except that the knitted gray fabric was dyed at 130° C. and final set at 180° C. Table 1 shows the results of evaluating the knitted fabric thus obtained.

It is evident from Table 1 that the knitted fabric compared with that in Example 4 showed a low elongation under constant load, a low elongation elastic modulus, a high shear rigidity and a stiff feeling. Moreover, the knitted fabric gave a poor wearable feeling.

<False-Twisting Conditions>

False twisting machine: ARCT-450 B, pin false twisting machine

Yarn speed: 84 m/min

Spin rotational speed: 277,000 rpm

Number of false twisting: 3,300 T/m

First feed: +2%

Heater temperature: 220° C.

TU feed: 5.03%

Example 5

The two false twisted yarns of 84 dtex/36 f obtained in Example 4 were doubled to form a false twisted yarn of 167 dtex/72 f. The false twisted yarn was knitted using a 22-gauge circular knitting machine while the loop length was set at 33.0 cm/100 wales (the length being longer by 15% than that for a PET yarn in Comparative Example 5 to be described later) to give an interlock knitted gray fabric having a density of 29 courses/2.54 cm and 45 wales/2.54 cm.

The knitted gray fabric was treated in the same manner as in Example 4 to give a knitted fabric having a density of 46 courses/2.54 cm and 50 wales/2.54 cm. Table 1 shows the results of evaluating the knitted fabric thus obtained.

Comparative Example 5

The two false twisted PET yarns of 84 dtex/36 f obtained in Comparative Example 4 were doubled to form a false twisted yarn of 167 dtex/72 f. The false twisted yarn was knitted using a 22-gauge circular knitting machine while the loop length was set at 28.7 cm/100 wales to give an interlock knitted gray fabric having a density of 38 courses/2.54 cm and 36 wales/2.54 cm.

The knitted gray fabric was treated in the same manner as in Comparative Example 4 to give a knitted fabric having a density of 48 courses/2.54 cm and 45 wales/2.54 cm. Table 1 shows the results of evaluating the knitted fabric thus obtained.

It is evident from Table 1 that the knitted fabric, compared with that in Example 5, showed a low elongation under constant load, a low elongation elastic modulus, a high shear rigidity and a stiff feeling. Moreover, the knitted fabric gave a poor wearable feeling.

Example 6

The interlock knitted gray fabric prepared in Example 5 was scoured in the same manner as in Example 1, opened, and preset at 160° C. for one minute with the width maintained using a pin tenter. The knitted fabric was then dyed, reduction cleaned, given a finish agent, and final set in the same manner as in Example 4 to give a knitted fabric having a density of 46 courses/2.54 cm and 46 wales/2.54 cm. Table 1 shows the results of evaluating the knitted fabric thus obtained.

Comparative Example 6

The procedure of Example 5 was repeated except that the loop length was changed to 28.7 cm/100 wales that is the same as in Comparative Example 5 to give an interlock knitted gray fabric having a density of 37 courses/2.54 cm and 41 wales/2.54 cm.

The knitted gray fabric was treated in the same manner as in Example 5 to give a knitted fabric having a density of 50 courses/2.54 cm and 58 wales/2.54 cm. Table 1 shows the results of evaluating the knitted fabric thus obtained.

The following have become evident from Table 1. In contrast to the knitted fabric in Example 5 in which the density of the gray fabric was made coarser than the interlock knitted gray fabric of Comparative Example 5 for which a PET yarn was used, the density of the gray fabric in the present comparative example became significantly higher than that in Example 5 because the loop length of the knitted fabric was set under the same conditions of Comparative Example 5. As a result, the knitted fabric thus obtained had an excessively high bulk density, shows a low elongation under constant load, a high shear rigidity and a slightly stiff feeling, and gave a less comfortable feeling to the wearer.

Comparative Example 7

The interlock knitted gray fabric prepared in Example 4 was opened, and preset at 190° C. for 1 minute with a pin tenter while the ratio of tentering a width of fabric was set at 10% in the weft direction. Next, the fabric was scoured, dyed, reduction cleaned, washed with water and dehydrated, and dried in the same manner as in Example 1. The dried knitted fabric was impregnated with a conventional finish agent, final set at 180° C. for 1 minute with the width maintained to give a knitted fabric having a density of 40 courses/2.54 cm and 46 wales/2.54 cm. Table 1 shows the results of evaluating the knitted fabric thus obtained.

The following have become evident from Table 1. Because the gray fabric in the present comparative example was preset at 190° C. with tentering a width of fabric and final set at 180° C. in contrast to the knitted fabric in Example 4 that was final set at 160° C., the crimps of the textured yarn were made to flow. As a result, the knitted fabric showed a greatly lowered elongation under constant load, a greatly lowered elongation recovery and poor shape stability, and gave a less comfortable feeling to the wearer.

Example 7

A PTT drawn yarn of 56 dtex/24 f was obtained by the same procedure as in Example 1. The drawn yarn showed a strength of 2.8 cN/dtex, an elongation of 46%, an elastic modulus of 24 cN/dtex, an elastic recovery after elongation by 10% of 95% and a boiling water shrinkage of 12%.

The PTT yarn of 56 dtex/24 f thus obtained and a rayon yarn of 84 dtex/33 f (manufactured by Asahi Chemical Industry Co., Ltd.) were mixed knitted while the loop length was set at 33.5 cm/100 wales using a 28-gauge circular knitting machine so that the constituent mass ratio of the PTT yarn to the rayon yarn became 67:33 in the knitted fabric to give an interlock knitted gray fabric having a density of 54 courses/2.54 cm and 44 wales/2.54 cm.

The knitted gray fabric was opened, and preset at 160° C. for 1 minute with a pin tenter while the reduction in width was set at 5% in the weft direction. Next, using a circular dyeing machine, the fabric was scoured at 90° C. for 20 minutes, dyed with a dispersion dye at 120° C. for 30 minutes, reduction cleaned at 80° C. for 10 minutes, dyed with a reactive dye at 60° C. for 60 minutes, and soaped at 80° C. for 10 minutes. The fabric was then dried, immersed in a conventional finish agent, squeezed so that the liquid was squeezed out, and final set at 150° C. for 1 minute with the width maintained to give a knitted fabric having a density of 65 courses/2.54 cm and 51 wales/2.54 cm. Table 1 shows the results of evaluating the knitted fabric.

Example 8

The PTT yarn of 56 dtex/24 f and a rayon yarn of 84 dtex/33 f (manufactured by Asahi Chemical Industry Co., Ltd.) were mixed knitted in the same manner as in Example 7 using a 28-gauge circular knitting machine so that the constituent mass ratio of the PTT yarn to the rayon yarn became 40:60 in the knitted fabric to give an interlock knitted gray fabric having a density of 51 courses/2.54 cm and 40 wales/2.54 cm.

The knitted gray fabric was treated in the same manner as in Example 7 to give a knitted fabric having a density of 68 courses/2.54 cm and 50 wales/2.54 cm. Table 1 shows the results of evaluating the knitted fabric.

Example 9

The PTT yarn of 56 dtex/24 f and the rayon yarn of 84 dtex/33 f (manufactured by Asahi Chemical Industry Co., Ltd.) were mixed knitted in the same manner as in Example 7 using a 28-gauge circular knitting machine so that the constituent mass ratio of the PTT yarn to the rayon yarn became 18:82 in the knitted fabric to give an interlock knitted gray fabric having a density of 52 courses/2.54 cm and 40 wales/2.54 cm.

The knitted gray fabric was treated in the same manner as in Example 7 to give a knitted fabric having a density of 64 courses/2.54 cm and 39 wales/2.54 cm. Table 1 shows the results of evaluating the knitted fabric.

Example 10

The false twisted yarn of a PTT yarn obtained in Example 4 was knitted while the loop length was set at 21.0 cm/100 wales (the length being longer by 15% than that of the PET yarn in Comparative Example 8 to be described later) using a 32-gauge circular knitting machine to give a plain knitted gray fabric having a density of 27 courses/2.54 cm and 50 wales/2.54 cm.

The knitted gray fabric was treated in the same manner as in Example 4 to give a knitted fabric having a density of 48 courses/2.54 cm and 52 wales/2.54 cm. Table 1 shows the results of evaluating the knitted fabric thus obtained.

Comparative Example 8

The false twisted yarn of a PET yarn of 84 dtex/36 f obtained in Comparative Example 4 was knitted while the loop length was set at 18.3 cm/100 wales using a 32-gauge circular knitting machine to give a plain knitted gray fabric having a density of 29 courses/2.54 cm and 52 wales/2.54 cm.

The knitted gray fabric was treated in the same manner as in Comparative Example 4 to give a knitted fabric having a density of 40 courses/2.5 cm and 48 wales/2.54 cm. Table 1 shows the results of evaluating the knitted fabric thus obtained.

It is evident from Table 1 that the knitted fabric compared with that in Example 10 showed a low elongation under constant load, a low elongation elastic modulus, a high shear rigidity and a stiff feeling. Moreover, the knitted fabric gave a poor wearable feeling.

Example 11

A drawn PTT yarn of 22 dtex/15 f was obtained in the same manner as in Example 1. The drawn yarn showed a strength of 2.7 cN/dtex, an elongation of 43%, an elastic modulus of 25 cN/dtex, an elastic recovery after elongation by 10% of 97% and a boiling water shrinkage of 12%.

The PTT yarn and a rayon yarn of 84 dtex/24 f (manufactured by Asahi Chemical Industry Co., Ltd.) were knitted while the loop length was set at 33.0 cm/100 wales (the length being longer by 20% than the PET yarn in Comparative Example 9 to be described later) using a 28-gauge circular knitting machine so that the constituent mass ratio of the PTT yarn to the rayon yarn became 20:80 in the knitted fabric to give an interlock knitted gray fabric having a density of 42 courses/2.54 cm and 42 wales/2.54 cm.

The knitted gray fabric was scoured at 90° C. for 20 minutes with a fluid-jet dyeing machine, opened, and preset at 160° C. for 1 minute using a pin tenter with the width maintained. The fabric was then dyed with a dispersion dye at 120° C. for 30 minutes using a fluid-jet dyeing machine, and reduction cleaned at 80° C. for 10 minutes. The fabric was subsequently dyed with a reactive dye at 60° C. for 60 minutes, soaped at 80° C. for 10 minutes, dried and immersed in a conventional finish agent. The liquid was squeezed out, and the fabric was final set at 150° C. for 1 minute with the width maintained to give a knitted fabric having a density of 48 courses/2.54 cm and 49 wales/2.54 cm. Table 1 shows the results of evaluating the knitted fabric.

Comparable Example 9

An interlock knitted gray fabric having a density of 47 courses/2.54 cm and 48 wales/2.54 cm was prepared in the same manner as in Example 11 except that a PET yarn of 22 dtex/15 f (manufactured by Asahi Chemical Industry Co., Ltd.) was used in place of the PTT yarn of 22 dtex/15 f used in Example 11 and that the loop length was changed to 27.5 cm/100 wales.

The knitted fabric was treated in the same manner as in Comparative Example 10 to be described later to give a knitted fabric having a density of 46 courses/2.54 cm and 50 wales/2.54 cm. Table 1 shows the results of evaluating the knitted fabric thus obtained.

It is evident from Table 1 that the knitted fabric compared with that in Example 11 showed a low elongation under constant load, a high shear rigidity and a stiff feeling. Moreover, the knitted fabric gave a poor wearable feeling, and runs were formed.

Comparative Example 10

An interlock knitted gray fabric having a density of 54 courses/2.54 cm and 46 wales/2.54 cm was obtained in the same manner as in Example 11 except that the loop length was the same as that in Comparative Example 9.

The knitted gray fabric was scoured at 90° C. for 20 minutes with a fluid-jet dyeing machine, dyed with a dispersion dye at 130° C. for 30 minutes, reduction cleaned at 80° C. for 10 minutes, dyed with a reactive dye at 60° C. for 60 minutes, and soaped at 80° C. for 10 minutes. The knitted fabric was then dried, and a finish agent is applied thereto. The knitted fabric was then dried at 140° C. for 2 minutes.

The mixed knitted fabric thus obtained had a density of 72 courses/2.54 cm and 66 wales/2.54 cm. Table 1 shows the results of evaluating the knitted fabric thus obtained.

The following have become evident from Table 1. Because the loop length of the knitted fabric was set under conventional conditions of the PET yarn in contrast to the knitted fabric in Example 11 in which the density of the gray fabric was made coarse, the density of the gray fabric in the present comparative example became significantly high in comparison with that in Example 11. Moreover, because the knitted fabric was not preset, the knitted fabric thus obtained had an excessively high bulk density, shows a low elongation under constant load, a low elongation elastic modulus and a slightly stiff feeling, and gave a less comfortable feeling to the wearer.

TABLE 1

| | Shrinkage coeff. (product/ gray fabric) | Fabric weight ($g/m^2$) | Bulk density ($g/cm^3$) | Elongation under constant load (%) | Shear rigidity G | Elongation elastic modulus (%) | Feeling | Comfort feeling to a wearer | Run |
|---|---|---|---|---|---|---|---|---|---|
| Ex. 1 | 1.34 | 189 | 0.41 | 130 | 0.30 | 96 | ◎ | ◎ | ○ |
| Ex. 2 | 1.60 | 215 | 0.50 | 105 | 0.75 | 98 | ○ | ◎ | ○ |
| Ex. 3 | 1.53 | 305 | 0.55 | 94 | 0.75 | 97 | ○ | ◎ | ○ |
| Ex. 4 | 1.88 | 240 | 0.30 | 140 | 0.44 | 95 | ◎ | ◎ | ○ |
| Ex. 5 | 1.76 | 350 | 0.41 | 110 | 1.18 | 96 | ○ | ○ | ○ |
| Ex. 6 | 1.62 | 320 | 0.40 | 130 | 0.83 | 96 | ◎ | ◎ | ○ |
| Ex. 7 | 1.40 | 149 | 0.34 | 115 | 0.42 | 89 | ◎ | ◎ | ○ |
| Ex. 8 | 1.64 | 159 | 0.37 | 100 | 0.37 | 86 | ◎ | ○ | ○ |
| Ex. 9 | 1.20 | 138 | 0.40 | 80 | 0.50 | 85 | ◎ | Δ | ○ |
| Ex. 10 | 1.85 | 120 | 0.50 | 200 | 0.28 | 86 | ◎ | ◎ | ○ |
| Ex. 11 | 1.33 | 180 | 0.50 | 120 | 0.78 | 88 | ○ | ○ | ○ |
| CE. 1 | 1.20 | 172 | 0.39 | 72 | 1.51 | 70 | x | x | x |
| CE. 2 | 1.36 | 204 | 0.40 | 68 | 1.81 | 72 | x | x | x |
| CE. 3 | 1.24 | 258 | 0.51 | 66 | 1.78 | 69 | x | x | x |
| CE. 4 | 1.19 | 230 | 0.32 | 78 | 1.54 | 73 | x | x | ○ |
| CE. 5 | 1.58 | 308 | 0.30 | 60 | 1.67 | 78 | x | x | ○ |
| CE. 6 | 1.91 | 356 | 0.62 | 72 | 1.52 | 90 | x | x | ○ |
| CE. 7 | 1.17 | 166 | 0.26 | 60 | 0.26 | 65 | ○ | x | ○ |
| CE. 8 | 1.27 | 100 | 0.47 | 100 | 1.52 | 64 | x | x | ○ |
| CE. 9 | 1.11 | 185 | 0.43 | 75 | 1.63 | 68 | x | x | x |
| CE. 10 | 1.91 | 220 | 0.61 | 65 | 1.52 | 74 | x | x | ○ |

INDUSTRIAL APPLICABILITY

The weft knitted fabric of the present invention is excellent in wash and wear properties, dimensional stability and yellowing resistance, has a dry touch and a soft feeling, shows excellent stretchability and elongation recovery, and gives an excellent comfortable feeling to the wearer. The knitted fabric is therefore appropriate to outerwear applications.

What is claimed is:

1. A weft knitted fabric comprising a weft knitted fabric made from a poly(trimethylene terephthalate) fiber yarn and not containing any other elastic yarns, said fabric having an elongation under constant load in a range from 80 to 250% in a weft direction under a load of 19.6N per 2.5 cm, an elongation elastic modulus after elongation by 50% of 80% or more in the weft direction, a fabric weight per square meter in a range from 80 to 500 $g/m^2$, a bulk density in a range from 0.28 to 0.60 $g/cm^3$ and a shear rigidity G in a range from 0.28 to 1.50 cN/cm•deg.

2. The weft knitted fabric according to claim 1, wherein the elongation under constant load is in a range from 90 to 200% in the weft direction under a load of 19.6N per 2.5 cm, the elongation elastic modulus after elongation by 50% is 85% or more in the weft direction, the fabric weight per square meter is in a range from 100 to 400 $g/m^2$, the bulk density is in a range from 0.30 to 0.55 $g/cm^3$ and the shear rigidity G is in a range from 0.30 to 1.30 cN/cm•deg.

3. The weft knitted fabric according to claim 1 or 2, wherein the weft knitted fabric has a density in a range from 15 to 80 couses/2.54 cm and from 15 to 70 wales/2.54 cm.

4. The weft knitted fabric according to claim 1 or 2, wherein the weft knitted fabric has a density in a range from 15 to 70 couses/2.54 cm and from 15 to 60 wales/2.54 cm.

5. The weft knitted fabric according to claim 1 or 2, wherein the weft knitted fabric has a density in a range from 30 to 70 couses/2.54 and from 30 to 60 wales/2.54 cm.

6. The weft knitted fabric according to claim 1 or 2, wherein the other elastic yarns are selected from the group consisting of polyurethane yarn, polyester elastic yarn and polyester ether elastic yarn.

7. A method for producing the weft knitted fabric according to any one of claims 1 or 5, wherein the weft knitted fabric has a shrinkage coefficient in a range from 1.2 to 1.9 as shown by the following formula, comprising heat treating a weft knitted gray fabric to shrink the fabric in the weft direction in a dyeing process and then finishing the gray fabric:

shrinkage coefficient={(number of courses of the product)×(number of wales of the product)}/{(number of courses of the gray fabric)×(number of wales of the gray fabric)}.

* * * * *

UNITED STATES PATENT AND TRADEMARK OFFICE

CERTIFICATE OF CORRECTION

PATENT NO. : 6,561,230 B1
DATED : May 13, 2003
INVENTOR(S) : Masataka Ikeda et al.

It is certified that error appears in the above-identified patent and that said Letters Patent is hereby corrected as shown below:

Column 18,
Line 42, "claims 1 or 5," should read -- claims 1 or 2, --.

Signed and Sealed this

Eleventh Day of November, 2003

JAMES E. ROGAN
*Director of the United States Patent and Trademark Office*